US009129565B2

(12) United States Patent
Wei et al.

(10) Patent No.: US 9,129,565 B2
(45) Date of Patent: Sep. 8, 2015

(54) ADJUSTING A BRIGHTNESS LEVEL OF A SIDE EMITTING BACKLIGHT DISPLAY DEVICE USING LIGHT SPREADING PROFILES

(75) Inventors: Zhang Wei, New Territorries (HK); Tsai Chen Jung, Shatin (HK)

(73) Assignee: Hong Kong Applied Science and Technology Research Institute, Co. Ltd., Shatin (HK)

( * ) Notice: Subject to any disclaimer, the term of this patent is extended or adjusted under 35 U.S.C. 154(b) by 102 days.

(21) Appl. No.: 13/343,667

(22) Filed: Jan. 4, 2012

(65) Prior Publication Data

US 2012/0105505 A1 May 3, 2012

Related U.S. Application Data

(63) Continuation-in-part of application No. 12/748,222, filed on Mar. 26, 2010, now Pat. No. 8,890,793.

(51) Int. Cl.
*G09G 3/36* (2006.01)
*G09G 3/34* (2006.01)

(52) U.S. Cl.
CPC ..... *G09G 3/3426* (2013.01); *G09G 2320/0646* (2013.01); *G09G 2360/144* (2013.01); *G09G 2360/16* (2013.01)

(58) Field of Classification Search
USPC ..... 345/87–104
See application file for complete search history.

(56) References Cited

U.S. PATENT DOCUMENTS

2005/0184952 A1* 8/2005 Konno et al. ..... 345/102
2007/0097045 A1 5/2007 Lee et al.
2007/0159448 A1* 7/2007 Inuzuka et al. ..... 345/102
2007/0279369 A1 12/2007 Yao et al.
2008/0050031 A1 2/2008 Itoh et al.
2008/0252666 A1* 10/2008 Chen et al. ..... 345/690
2009/0079768 A1 3/2009 Huang
2009/0167671 A1 7/2009 Kerofsky
2009/0184917 A1 7/2009 Park et al.
2009/0219244 A1 9/2009 Fletcher et al.
2009/0278789 A1 11/2009 Declercq et al.
2010/0045694 A1 2/2010 Tanaka et al.
2010/0123742 A1* 5/2010 Jang ..... 345/690
2010/0220048 A1* 9/2010 Yamamura et al. ..... 345/102
2010/0309109 A1 12/2010 Won (Continued)

FOREIGN PATENT DOCUMENTS

CN 101281730 10/2008

OTHER PUBLICATIONS

U.S. Appl. No. 12/748,222, filed Mar. 26, 2010, 45 Pages.

(Continued)

*Primary Examiner* — Sanghyuk Park

(74) *Attorney, Agent, or Firm* — Berkeley Law & Technology Group, LLP

(57) ABSTRACT

Embodiments of methods, systems, or apparatuses relating to adjusting a brightness level of at least one luminescent body disposed, at least in part, on a side emitting backlight display device are disclosed. In a particular embodiment, for example, one or more values representing a light spreading profile for a particular luminescent body may be accessed. A process, system, or apparatus may adjust a brightness of a particular luminescent body by adjusting one or more brightness values associated with that particular luminescent body based, at least in part, on the accessed values.

18 Claims, 8 Drawing Sheets

(56) References Cited

U.S. PATENT DOCUMENTS

| | | | | |
|---|---|---|---|---|
| 2011/0069078 | A1 | 3/2011 | Zhang et al. | |
| 2011/0141155 | A1* | 6/2011 | Hong et al. | 345/690 |
| 2011/0234612 | A1 | 9/2011 | Wei | |

OTHER PUBLICATIONS

U.S. Appl. No. 12/748,222 /: Filing Receipt, Mailed Apr. 8, 2010, 3 Pages.
U.S. Appl. No. 12/748,222 /: Notice of Publication, Mailed Sep 29, 2011, 1 Page.
U.S. Appl. No. 12/748,222 /: Non-Final Office Action, Mailed Jun. 21, 2012, 13 Pages.
U.S. Appl. No. 12/748,222 /: Non-Final Office Action Response, Mailed Oct. 25, 2012, 17 Pages.
U.S. Appl. No. 12/748,222 /: Final Office Action, Mailed Apr. 5, 2013, 18 Pages.
U.S. Appl. No. 12/748,222 /: Request for Continued Examination, Mailed Aug. 5, 2013, 18 Pages.
U.S. Appl. No. 12/748,222 /: Non-Final Office Action, Mailed Sep. 25, 2013, 6 Pages.
U.S. Appl. No. 12/748,222 /: Non-Final Office Action Response, Mailed Jan. 21, 2014, 12 pages.
U.S. Appl. No. 12/748,222 /: Notice of Allowance and Fees Due (PTOL-85), Mailed May 22, 2014, 5 Pages.
U.S. Appl. No. 12/748,222 / Request for Continued Examination, mailed Jul. 16, 2014, 3 pages.

* cited by examiner $$\begin{pmatrix} W_{0,0} & \cdots & W_{0,J} \\ \vdots & \ddots & \vdots \\ W_{I,0} & \cdots & W_{I,J} \end{pmatrix} \quad \underline{400}$$

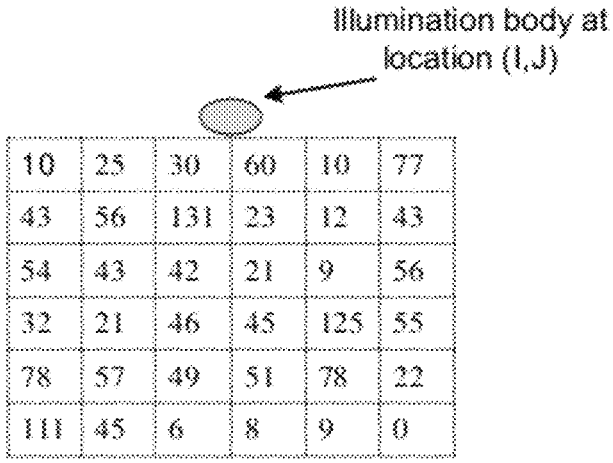
| | | | | | |
|---|---|---|---|---|---|
| 10 | 25 | 30 | 60 | 10 | 77 |
| 43 | 56 | 131 | 23 | 12 | 43 |
| 54 | 43 | 42 | 21 | 9 | 56 |
| 32 | 21 | 46 | 45 | 125 | 55 |
| 78 | 57 | 49 | 51 | 78 | 22 |
| 111 | 45 | 6 | 8 | 9 | 0 |
FIG. 8A
| | | | | | |
|---|---|---|---|---|---|
| 0.6 | 1 | 1.5 | 1.5 | 1 | 0.6 |
| 0.8 | 1.1 | 1.2 | 1.2 | 1.1 | 0.8 |
| 0.7 | 1 | 1.1 | 1.1 | 1 | 0.7 |
| 0.5 | 0.8 | 0.9 | 0.9 | 0.8 | 0.5 |
| 0.3 | 0.4 | 0.7 | 0.7 | 0.4 | 0.3 |
| 0 | 0.2 | 0.3 | 0.3 | 0.2 | 0 |
FIG. 8B
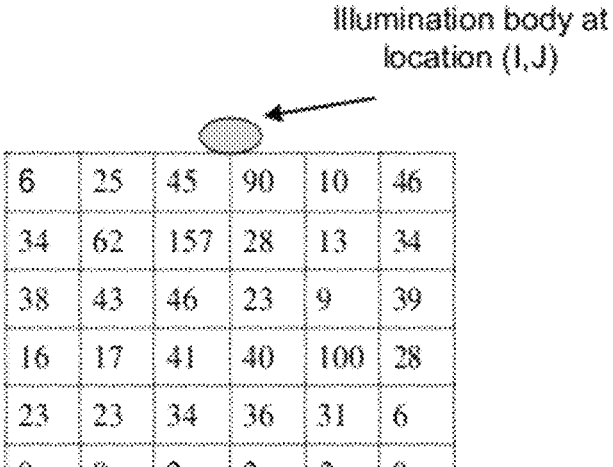
| | | | | | |
|---|---|---|---|---|---|
| 6 | 25 | 45 | 90 | 10 | 46 |
| 34 | 62 | 157 | 28 | 13 | 34 |
| 38 | 43 | 46 | 23 | 9 | 39 |
| 16 | 17 | 41 | 40 | 100 | 28 |
| 23 | 23 | 34 | 36 | 31 | 6 |
| 0 | 9 | 2 | 2 | 2 | 0 |
FIG. 8C

ADJUSTING A BRIGHTNESS LEVEL OF A SIDE EMITTING BACKLIGHT DISPLAY DEVICE USING LIGHT SPREADING PROFILES

CROSS-REFERENCE TO RELATED APPLICATIONS

This application is a Continuation-In-Part of co-pending U.S. patent application Ser. No. 12/748,222, filed on Mar. 26, 2010 by Zhang Wei, et al., and entitled "Adjusting a Brightness Level of a Display Device", the entirety of which is incorporated by reference herein.

BACKGROUND

1. Field

The subject matter disclosed herein relates to methods, systems, or apparatuses relating to adjusting a brightness level of at least one luminescent body disposed, at least in part, on a side emitting backlight display device.

2. Information

Side emitting backlights may be used as a light source in display devices, such as televisions, handheld devices, computer devices, or the like. While side emitting backlights may be desirable for certain devices, or for certain display features, there may also be some challenges with display characteristics for side emitting backlights. As just one example, luminescent bodies disposed on a side emitting backlight may have light distribution characteristics that affect image display characteristics for the device in ways that may be undesirable for a viewer.

Accordingly, there may be a desire to continue to develop approaches or techniques which may potentially mitigate undesirable display characteristics or improve display characteristics which are believed to be desirable.

BRIEF DESCRIPTION OF DRAWINGS

Subject matter is particularly pointed out and distinctly claimed in the concluding portion of the specification. Claimed subject matter, however, both as to organization and method of operation, together with objects, features, and advantages thereof, may best be understood by reference of the following detailed description if read with the accompanying drawings in which:

FIGS. 8A-8C depict exemplary values associated with adjusting a brightness level of at least one luminescent body disposed, at least in part, on a side emitting backlight display device, in accordance with one or more embodiments.

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, methods, apparatuses, or systems that would be known by one of ordinary skill have not been described in detail so as not to obscure claimed subject matter.

As discussed above, side emitting backlights may be used as a light source in display devices, such as televisions, handheld devices, computer devices, and/or the like. In this context, a side emitting backlight comprises a backlight where one or more luminescent bodies of the backlight are disposed, at least in part, proximate to one or more edges, such as horizontal and/or vertical edges, of the display device.

As mentioned previously, a potential challenge with display characteristics of a local dimming side emitting display device may be that one or more luminescent bodies may have light distribution characteristics that affect image display characteristics for the device in ways that may be undesirable for a user. For example, luminescent bodies at least partially disposed proximate to an edge of a display device may distribute light in a non-regular manner.

Figure 3A:
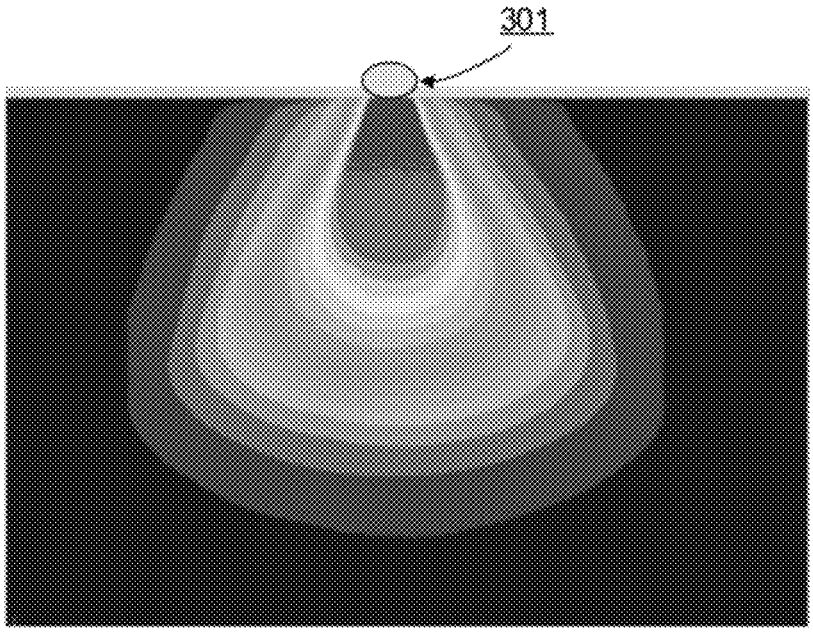
FIGS. 3A-3D depict exemplary technique to determine one or more values representing a light spreading profile for a luminescent body disposed, at least in part, on a side emitting backlight display device, in accordance with one or more embodiments.
Figure 3B:
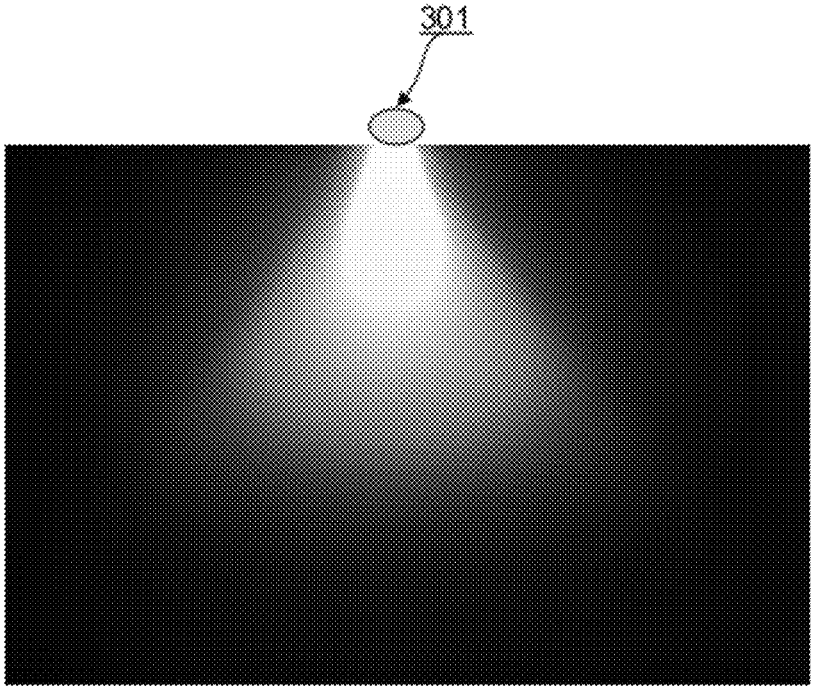
Figure 3C:
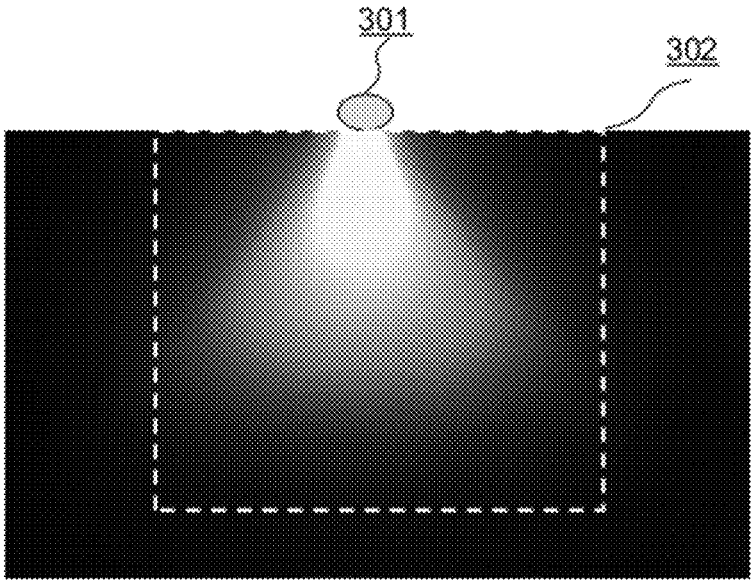

Display screen 300 in FIG. 3C, for example, depicts exemplary light distribution characteristics of luminescent body 301 disposed as part of a backlight of a side emitting display device. As can be observed from screen 300, a light spreading profile for luminescent body 301 may be said to have an asymmetrical shape with respect to a segment 302 of display screen 300 (e.g., segment 302 is depicted by dashed line). For instance, light emitted by luminescent body 301 in the vertical direction may not be concentrated in the center of segment 302, as just an example. Likewise, as can also be noted from screen 300, a light spreading profile for luminescent body 301 may show relatively less optical crosstalk with neighboring segments (not depicted), such as around the top horizontal edges of screen 300; conversely, a light spreading profile for luminescent body 301 may show relatively more crosstalk toward the center of screen 300.

These and other light distribution characteristics, such as those illustrated by FIG. 3C, may result in certain undesirable display characteristics. For LCD display devices, as just an example, a point spreading profile of a luminescent body may affect a multiplicity of LCD pixels. Correspondingly, one LCD pixel value may affect the value determination of plurality of luminescent bodies. Such characteristics of side emitting backlights may affect the display characteristics on an LCD screen. As just an example, if one or more values of luminescent bodies are not properly obtained, such characteristics may result in portions of a displayed image being too dim or too bright for a particular viewer, particularly when a viewer may be attempting to view images on the device in particular ambient light conditions.

In addition to the above, there may be other undesirable display characteristics associated with light distribution characteristics of side emitting display devices. Some exemplary undesirables may include the so called "Halo" artifact, such as static or motion halos viewable to a user, or so called "flickering artifacts", such as may be occasioned when backlight intensity changes too fast with respect to a displayed image, as just some examples.

With these and other concerns in mind, in accordance with certain aspects of the present description, example implementations may include methods, systems, or apparatuses for adjusting a brightness level of at least one luminescent body disposed, at least in part, on a side emitting backlight display device. In a particular embodiment, for example, adjusting a brightness level of at least one luminescent body may include accessing one or more values representing a light spreading profile for a particular luminescent body and adjusting one or more intensity values associated with that particular luminescent body based, at least in part, on accessed values representing the light spreading profile of that particular luminescent body.

In this context, a "brightness" or "brightness level" of a luminescent body, such as may be measured in cd/m$^2$, may correspond to one or more intensities associated with one or more signal values which may control a brightness or color of a luminescent body. Accordingly, in certain embodiments, adjusting a brightness level may include adjusting an intensity associated with one or more such signal values, as just an example.

Figure 1:
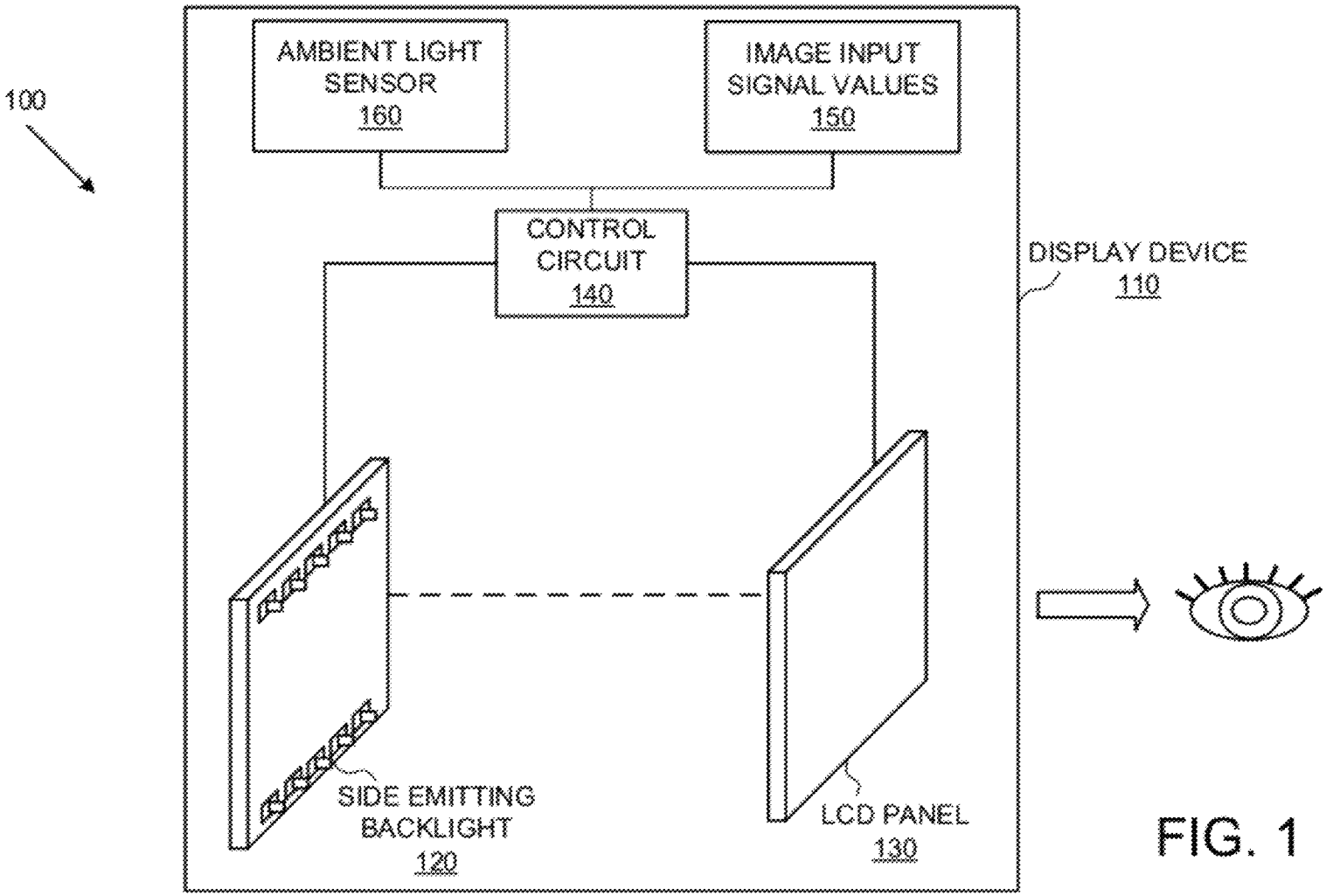
FIG. 1 is a schematic diagram depicting an embodiment of an exemplary display device capable of adjusting a brightness level of at least one luminescent body disposed, at least in part, on a side emitting backlight display device.

FIG. 1 is a schematic diagram depicting embodiment 100 of exemplary display device 110 capable of adjusting a brightness level of at least one luminescent body disposed as part of a side emitting backlight display device. Here, for example, display device 110 may comprise any display device, such as a television, a handheld device, a computer device, or the like, as non-limiting examples. It should be noted that, for illustrative purposes, embodiment 100 depicts a simplified representation of display device 110. Accordingly, display device 110 may include numerous components, devices, etc., which have not been depicted in embodiment 100 so as to not obscure claimed subject matter. Thus, display device 110 may include one or more image processors, diffusers, drivers, microcontrollers, microprocessors, memories, buses, sensors, filters, or other components or devices, as non-limiting examples. Of course, many of these omitted components or devices may perform, in whole or in part, one or more of the functions described herein.

Display device 110 is depicted having a side emitting backlight 120 which includes a plurality of luminescent bodies disposed on the edges of the display device. In this context, a luminescent body means a body capable of emitting light. For instance, a luminescent body associated with side emitting backlight 120 may comprise a light emitting diode (LED), a cold cathode fluorescent lamp (CCFL), a surface conduction electron emitter display (SED), a field emission display (FED), or the like, as non-limiting examples. Accordingly, in certain embodiments, side emitting backlight 120 may comprise a backlight including a plurality of LEDs disposed, at least in part, on one or more edges. In certain embodiments, LEDs may have multiple color channels, as just an example. Here it is noted that side emitting backlight 120 is depicted with a plurality of luminescent bodies disposed on two horizontal edges of the display device. This depiction is simplified for illustrative purposes; thus, the scope of claimed subject matter is not to be limited. Accordingly, as just an example, a side emitting backlight may have one or more luminescent bodies at least partially disposed anywhere on one or more edges of the display device.

Display device 110 is depicted having a liquid crystal display (LCD) panel 130. In particular implementations, an LCD may employ a side emitting backlight to produce light since LCDs are generally not capable of doing so. Thus, in display device 110, side emitting backlight 120 is depicted as being coupled with LCD panel 130. In embodiment 100, side emitting backlight 120 may emit light, some of which may pass through LCD panel 130, as depicted by the direction the arrow in FIG. 1, to a viewer's eye.

In embodiment 100, control circuit 140 may comprise a microcontroller, microprocessor, integrated chip (IC), and/or the like, as non-liming examples. As suggested above, control circuit 140 is depicted being electrically coupled to side emitting backlight 120 and LCD panel 130. In embodiment 100, control circuit 140 may receive one or more input image signal values, such as image input signal value 150, for example. In certain embodiments, image input signal values 150 may comprise binary digital signals representative of one or more images, such as one or more image frames, for example. Accordingly, image input signal values 150 may include image signal values which, if processed, may correspond, at least in part, to brightness or intensity values for one or more luminescent bodies associated with side emitting backlight 120, as just an example.

In embodiment 100, display device 110 is depicted having ambient light sensor 160. Ambient light sensor 160 may comprises any device or component capable of measuring, sensing, or otherwise determining one or more ambient light values associated with display device 110. For example, ambient light sensor 160 may include one or more photo diodes, photo resistors, and/or photo transistors, as non-limiting examples. Ambient light values associated with a display device may represent, as some non-limiting examples, a quantum or intensity of light incident on at least a portion of a surface of display device or a quantum or intensity of light around a display device (e.g., environmental lighting conditions), such as may be measured in lux, as just an example. As just an example, ambient light sensor 160 may be of the type described in Ser. No. 12/748,222, filed on Mar. 26, 2010 by Zhang Wei, et al., and entitled "Adjusting a Brightness Level of a Display Device". Of course, it is noted, however, that claimed subject matter is not to be limited to any particular sensor type, method or technique for sensing, nor is sensing limited spatially or temporally to particular environments or conditions.

As mentioned above, in certain embodiments, control circuit 140 is capable of adjusting a brightness level of a particular luminescent body disposed on side emitting backlight 120 based, at least in part, on values representing a light spreading profile for a particular luminescent body. For example, in certain embodiments, control circuit 140 may access one or more values representing a light spreading profile for a particular luminescent body and filter one or more image characteristic values, such as one or more image input signal values, image sub-portion representative values, weighted brightness values, or other image values, which may represent input image values or portions of image characteristics through at least one light spreading profile weighting functions. Furthermore, in certain embodiments, control circuit 140 may adjust one or more pixel values, such as red, green, or blue pixel values of LCD panel 130 based, at least in part, on one or more processed image input signal values and determined luminescent body brightness values, as just an example. To perform one or more of these various operations, control circuit 140 may utilize one or more of approaches or techniques described herein, such as in FIG. 2, for example. Of course, as mentioned previously, while one or more processes or operations depicted in FIG. 2 may be performed by a control circuit, such as control circuit 140, one or more of such processes or operations may be performed in certain embodiments, in whole or in part, via various components or devices. Accordingly, the scope of claimed subject matter is not limited to examples or illustrations.

Figure 2:
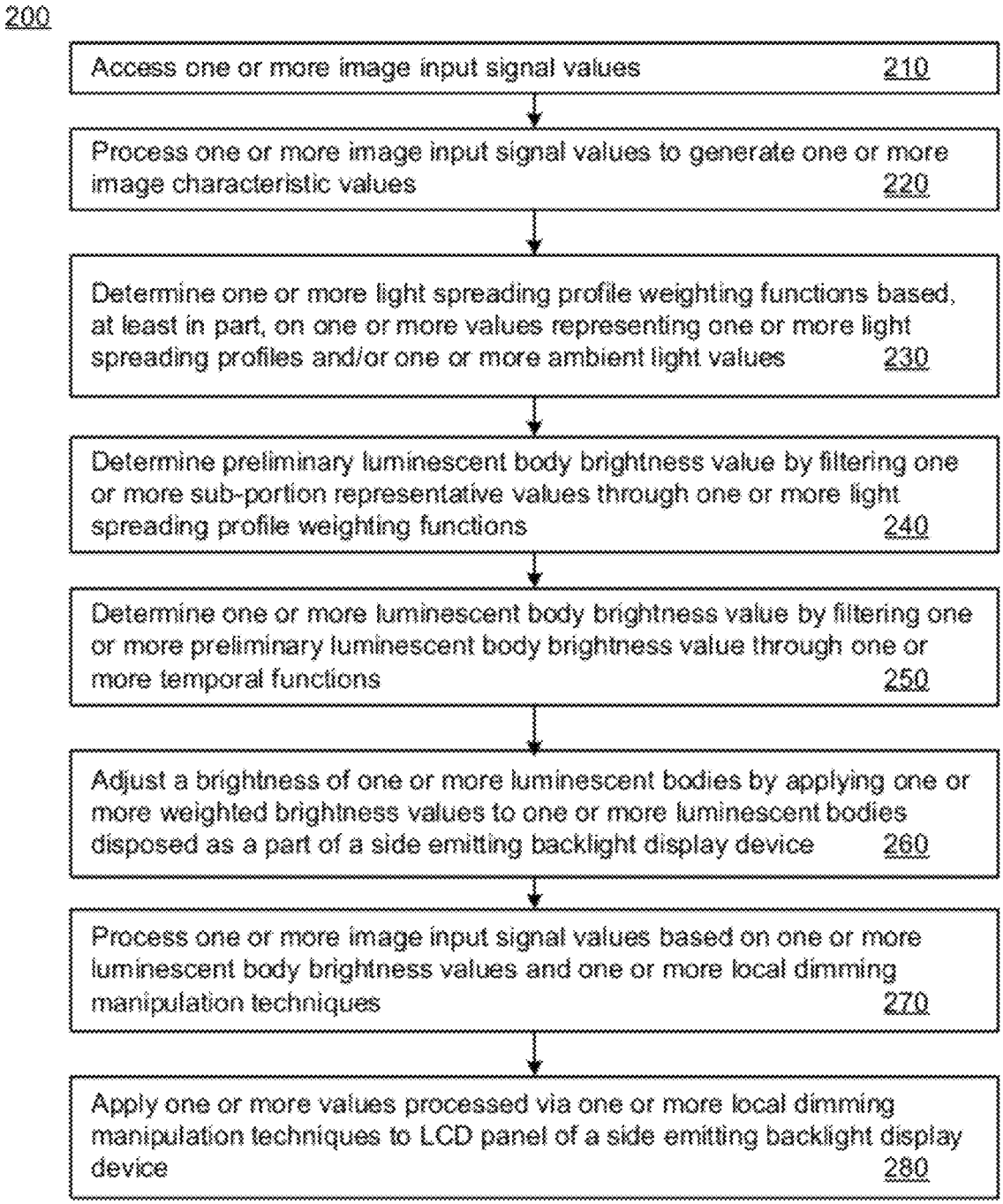
FIG. 2 is a flow diagram depicting an embodiment of an exemplary method for adjusting a brightness level of at least one luminescent body disposed, at least in part, on a side emitting backlight display device.

FIG. 2 depicts embodiment 200 of an exemplary method for adjusting a brightness level of at least one luminescent body disposed, at least in part, on a side emitting backlight display device. At block 210, a process, system or apparatus may access one or more image input signal values, such as image input signal values 150. Here, image input signal values may comprise binary digital signals representative of one or more images, such as one or more image frames of one or more various color channels, which, if processed, may correspond, at least in part, to brightness or intensity values corresponding to one or more luminescent bodies, as just an example.

As suggested above, at block 220, a process, system or apparatus may process one or more image input signal values to generate one or more image characteristic values. In embodiment 200, as just an example, such one or more image characteristic values may comprise one or more image sub-portion representative values. Though, in other embodiments, one or more image characteristic values may comprise intensity values that may be processed by a variety of techniques. Accordingly, the scope of claimed subject matter is not limited in this respect.

Since a variety of ways may exist to generate one or more sub-portion representative values, it would not be feasible to list all such techniques. In is noted, then, that while claimed subject matter is not to be limited to any particular technique or approach that may be utilized at block 220, one exemplary technique that may be utilized, for example, is described in U.S. patent application Ser. No. 12/565,635 entitled, "Method, system or apparatus for adjusting a brightness level associated with at least a portion of a backlight of a display device," and filed on Sep. 23, 2009. A simplified recitation of this technique is described below.

According to the above-referenced patent application, image information, such as image frames, may be partitioned, portioned, or otherwise divided, such as by a control circuit, into a plurality of image portions. Such image portions may be further portioned into a plurality of image sub-portions from one or more of image portions. For one or more such image sub-portions, corresponding representative signal values may be determined. As described in the above-referenced patent application, representative signal values may comprise one or more values which represent image properties associated with image sub-portions, such as intensity, brightness, peak or average luminance value, peak or average value for color channels, or the like, as just a few examples. To illustrate, paraphrasing the above-referenced patent application, representative signal values may be selected by using peak subpixel signal value (e.g., $Peak_i=Max(R_i, G_i, B_i)$) associated with a particular image sub-portion. Here, subpixel values may comprise $R_i$, $G_i$, $B_i$ which represent intensity or brightness values, for a particular pixel $P_i$, associated with red, green, and blue color channels, respectively, for a particular image sub-portion, as an example. Thus, in certain embodiments, a representative value associated with a particular image sub-portion may be determined as: Representative Value=$Max(Peak_{ij})$ for an image sub-portion. Here, the subscript "ij" may designate a particular pixel location in image sub-portion, such as using a Cartesian coordinate system identifying a particular pixel located at row i, column j, as just an example. It is noted, however, that the above technique shows merely one exemplary way to process one or more image input signal values to generate one or more sub-portion representative values; accordingly, the scope of claimed subject matter is not to be limited to any particular technique.

As discussed in more detail below, such image input signal values may be processed to generate one or more luminescent body brightness values associated with one luminescent bodies, according to one or more sub-portion representative values. In certain embodiments, one or more sub-portion representative values may be filtered through one or more light spreading profile weighting functions and/or one or more temporal functions.

In this context, a light spreading profile weighting function comprises a function which may be applied to one or more image characteristic values, such as one or more image sub-portion representative values. A light spreading profile weighting function represents one or more particular light spreading profiles for one or more particular luminescent bodies. In this context, a temporal function comprises a function which may be applied to one or more determined preliminary luminescent body brightness values of a current frame and at least one previous signal control value for one or more particular luminescent bodies. Light spreading profile weighting functions and temporal functions are discussed in more detail below.

In addition, in certain embodiments, one or more image input signal values, or other values, may be further processed using one or more local dimming manipulation techniques. In certain embodiments, such processing using one or more local dimming manipulation techniques may be performed according to one or more processed signal values corresponding to one or more luminescent bodies, such as described in more detail below. In certain embodiments, one or more image input signal values processed via one or more local dimming manipulation techniques may be applied to an LCD panel of said display device, in certain embodiments.

At block 230, a process, system or apparatus may determine one or more light spreading profile weighting functions based, at least in part, on one or more values representing one or more light spreading profiles, and/or on one or more ambient light values, or combinations thereof.

As just mentioned, a process, system or apparatus may determine one or more light spreading profile weighting functions based, at least in part, on one or more values representing one or more light spreading profiles. To illustrate, referring again to FIG. 3C, suppose luminescent body 301 was associated with particular luminescent body brightness values, as just an example. Here, a process, system or apparatus may access one or more values representing one or more light spreading profiles for luminescent body 301 to determine a light spreading profile weighting function for luminescent body 301. Such values representing a light spreading profile for luminescent body 301 are depicted graphically as exemplary light spreading profile weighting function 401 in FIG. 4B. Such values may be predetermined and stored in device memory (not depicted).

In certain embodiments, however, one or more light spreading profile weighting functions may be determined. Accordingly, since a variety of ways may exist to determine one or more light spreading profile weighting functions, it would not be feasible to list all such techniques. Thus, it is noted, then, that while claimed subject matter is not to be limited to any particular technique or approach that may be utilized at block 230, one exemplary technique is described below.

To determine an exemplary light spreading profile weighting function, reference is made to FIG. 3A. Here, FIG. 3A, depicts an exemplary image intensity for illuminated luminescent body 301 in the center of a display device. Here, for example, red coloring may indicate a higher cd/m$^2$value and, conversely, blue coloring may indicate a lower cd/m$^2$ value FIG. 3B depicts an exemplary light intensity after the light generated by illuminated luminescent body 301 passes through a diffuser sheet (not depicted) and LCD panel (not depicted).

In FIG. 3B, a process, system, and/or apparatus may convert the image into a display dimension domain. For example, for sake of illustration, suppose the display dimension of FIG. 3B is 1920×1080 pixels. As such, based on the display's coordinates and the light intensity, a process, system and/or apparatus may convert the image into 1920×1080 dimensions, which is consistent with the display's dimension as depicted by FIG. 3B.

Next, in FIG. 3C, a process, system and/or apparatus may determine a truncated area, such as the 10% truncation area depicted by segment 302, for calculation simplification. In this illustration, segment 302 will be the image area to be considered when determining the corresponding LED preliminary intensity value. Of course, it is noted that in other embodiments such truncation may not occur; in addition, such truncation may use a range of area sizes, which may be larger or smaller than the 10% truncation area depicted by segment 302. Accordingly, the scope of claimed subject matter is not to be limited in this respect.

Figure 3D:
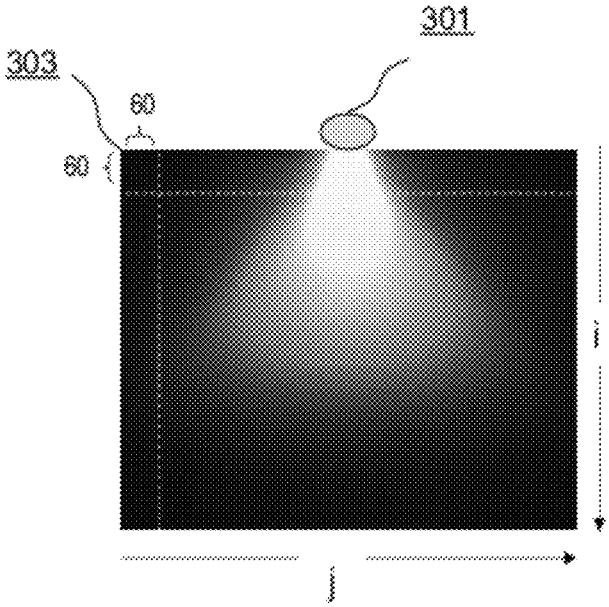

Next, as depicted in FIG. 3D, a process, system and/or apparatus may portion segment 302 into a plurality of i×j sub-image blocks. In FIG. 3D, sub-image block 303 is depicted as being 60×60 pixels, as just an example. In certain embodiments, sub-image blocks may have the same dimension as the dimension of image sub-portions associated with representative value determination. As such, the sub-image block used for light spreading profile weighting table construction may be consistent with the size of image sub-portions used for representative value determination. Of course, in certain embodiments, the respective sizes of sub-image blocks and sub-portions for representative value calculation may differ; accordingly, the scope of claimed subject matter is not to be limited in this respect.

Continuing with the illustration, in FIG. 3D, a process, system, and/or apparatus may sum the light spreading intensity values within such sub-image blocks and determine an intensity Wij for one or more sub-image blocks for segment 302. In such a manner, Wij for each sub-image block may be determined and stored in a display device memory (not depicted).

Figures 4A, 4B:
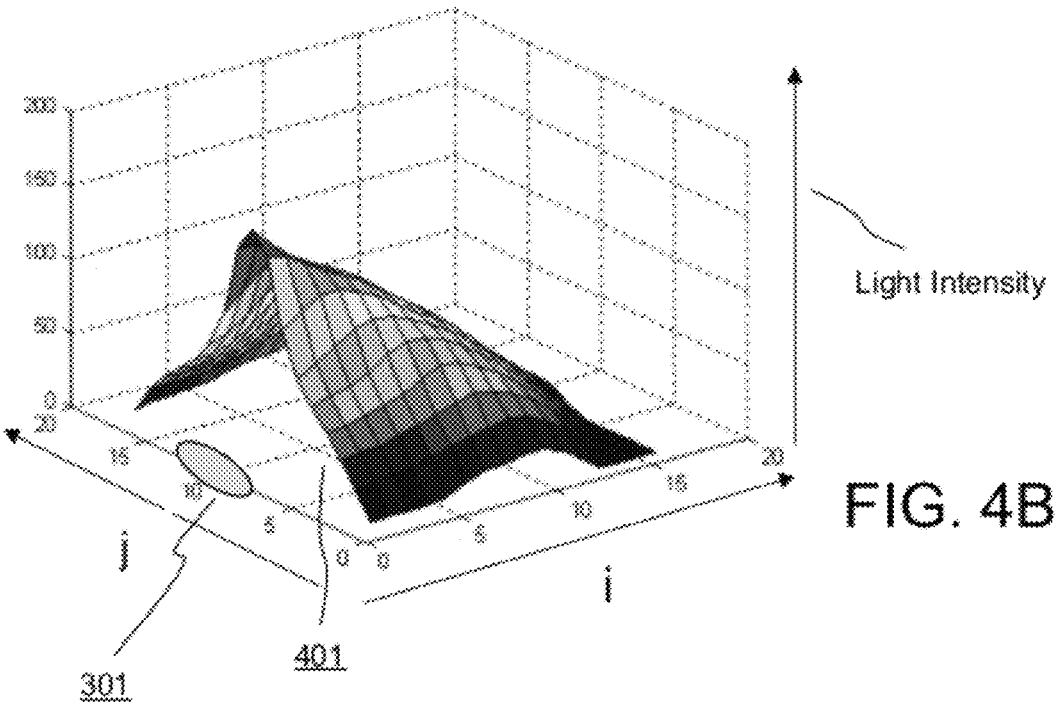
FIGS. 4A and 4B depict a values matrix and a chart, respectively, which depict exemplary values representing a light spreading profile for a luminescent body disposed, at least in part, on a side emitting backlight display device, in accordance with one or more embodiments.

FIG. 4A depicts an exemplary light spreading profile weighting function matrix. One or more Wij values that may be determined, such as determined based on the above-described technique, may be normalized and used to construct the profile weighting function matrix depicted by FIG. 4A. For example, Wij values may construct a matrix with values for I sub-image blocks in the vertical direction and values for J sub-image blocks in the horizontal direction.

FIG. 4B graphically depicts a light spreading profile weighting function 401, which may be constructed using a set of Wij values from the light spreading profile weighting function matrix depicted by FIG. 4A. Accordingly, light spreading profile 401 tends to show the light distribution characteristics of light emitted from luminescent body 301. In such a way, a light spreading profile weighting function for a particular luminescent body may be determined for one or more types of luminescent bodies.

Also, as mentioned above at block 230, a process, system or apparatus may determine one or more light spreading profile weighting functions based, at least in part, on one or more ambient light values.

In certain embodiments, ambient light values may be determined by ambient light measurements performed by ambient light sensor 160 in FIG. 1, for example. Since a variety of techniques may exist to determine ambient light values, it would not be feasible to list all such techniques. In is noted, then, that while claimed subject matter is not to be limited to any particular technique or approach, one exemplary technique that may be utilized at block 230, for example, is described in the aforementioned U.S. patent application Ser. No. 12/565,635 entitled, "Method, system or apparatus for adjusting a brightness level associated with at least a portion of a backlight of a display device," filed on Sep. 23, 2009. A simplified recitation of this technique is described below.

For example, according to the above-mentioned patent application, ambient light values may be measured in lux. In certain embodiments, depending on a quantum of lux sensed, measured, or detected, a process, system or apparatus at block 230 may determine a particular profile of a light spreading profile weighting function. Generally speaking, ambient light values which may correspond to higher lux (e.g., brighter) ambient lighting conditions may result in a "sharper" light spreading profile weighting function being determined, whereas ambient light values corresponding to lower lux (e.g., dimmer) ambient lighting conditions may result in a "smoother" light spreading profile weighting function being determined.

Figure 5:
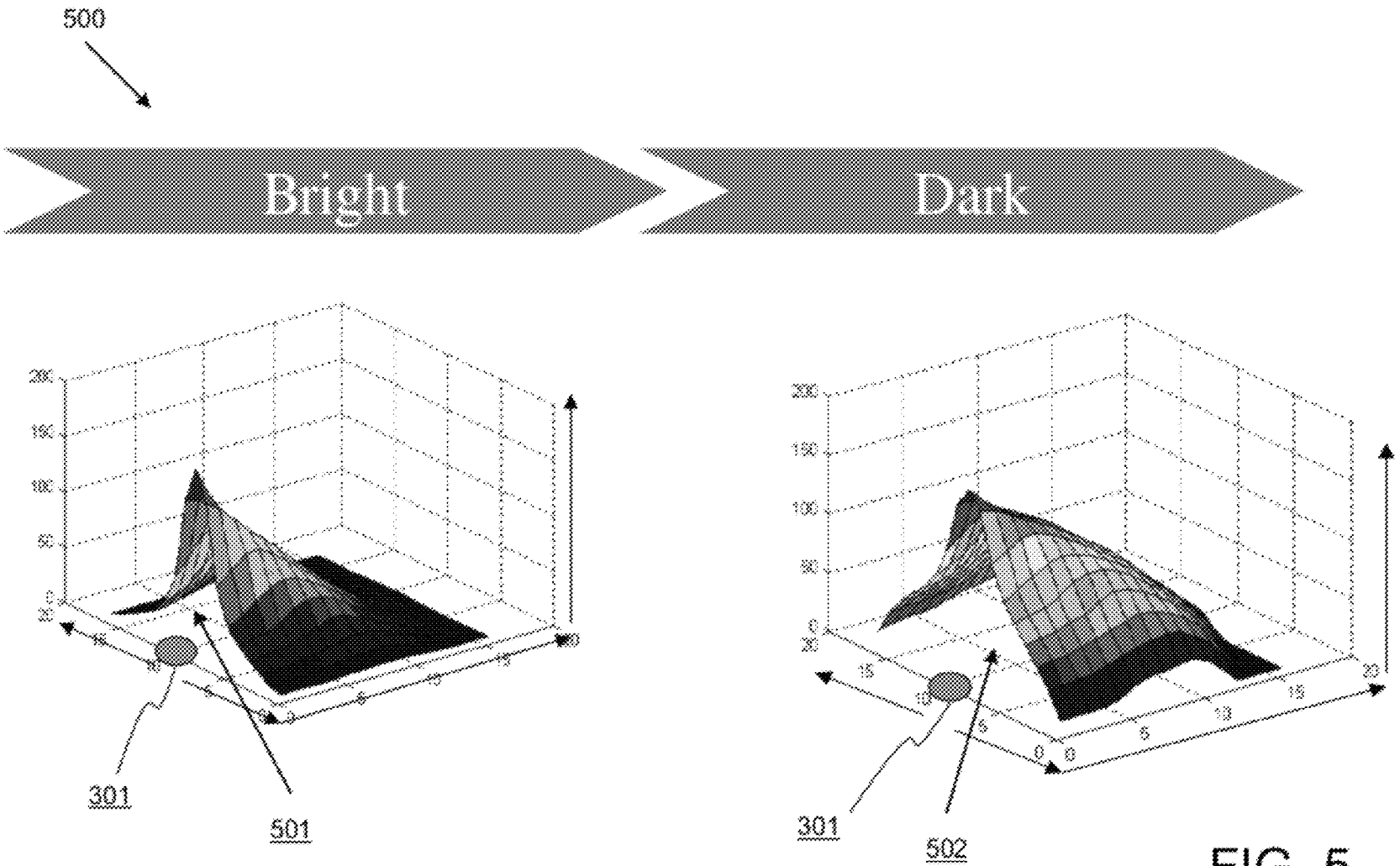
FIG. 5 illustrates exemplary light spreading profile weighting functions used to adjust a brightness level of at least one luminescent body disposed, at least in part, on a side emitting backlight display device, in accordance with one or more embodiments.

FIG. 5, for example, shows various, exemplary profiles of light spreading profile weighting functions which may be determined and be used to adjust a brightness level of one or more luminescent bodies of at least a portion of a side emitting backlight display device, in accordance with one or more embodiments.

In FIG. 5, ambient lighting conditions scale 500 is provided as an exemplary reference to show types of profiles which may be determined based on one or more ambient light values. Regarding this scale, it is noted that any values that may be referenced as corresponding to "dark" or "bright" ambient light conditions, are labeled as such merely for illustrative purposes. Similarly, exemplary light spreading profile weighting functions 501 and 502 are depicted as corresponding to "bright" or "dark" ambient light values are also illustrative. Also, while only two exemplary profiles are provided, it is noted that there are numerous profile shapes that may be determined which are omitted so as to not obscure claimed subject matter. Accordingly, the scope of claimed subject matter is not limited to such illustrations or examples.

Here, in FIG. 5, scale 500 first depicts "bright" ambient lighting conditions, such as those which may correspond to lux values exceeding approximately 4000 lux, as just an example. In such ambient lighting conditions, light spreading profile weighting function 501 may be determined. In contrast, in "dark" ambient lighting conditions, such as those corresponding to between 0 to approximately 200 lux, a "smooth" local weighing function, such as profile weighting function 502, may be determined.

Here, it is noted that FIG. 5 depicts a scale which may be non-liner to the extent that a characterization of lux corresponding to "bright" or "dark" ambient light conditions may vary according to the brightness perception characteristics of the human eye. Accordingly, the characterizations of lux corresponding to particular "bright" or "dark ambient light condition is done merely for convenience and simplicity; accordingly, the scope of claimed subject matter is not to be limited by such characterizations.

In certain embodiments, particular profiles of profile weighting functions may be determined so as to produce particular display characteristics. For instance, profile 502 for "Dark" ambient lighting conditions may have an effect of lowering a contrast between and/or among one or more luminescent bodies neighboring a particular luminescent body disposed on at least a portion of a side emitting backlight display device. Likewise, profile 501, for example, may have an effect of increasing a contrast between and/or among one or more luminescent bodies neighboring a particular luminescent body disposed on at least a portion of a side emitting backlight display device. As may be apparent from the foregoing, a vast number of profile shapes may be determined based on a variety of ambient light values; accordingly, the scope of claimed subject matter is not to be limited to any examples or illustrations.

As mentioned above at block 230, a process, system or apparatus may determine one or more light spreading profile weighting functions based, at least in part, on one or more values representing one or more light spreading profiles and one or more ambient light values. Thus, in certain embodiments, a process, system or apparatus may determine one or more light spreading profile weighting functions that may be a combination of normalized light spreading profile values, such as a set of Wij values from the light spreading profile weighting function matrix depicted by FIG. 4A, which are further adjusted using one or more ambient light values.

For example, a process, system or apparatus may first determine a weighting matrix "W" based on a light spreading profile for a particular luminescent body as described above. Here, such a weighting matrix "W" may be normalized with max value=1.0 (see matrix below).

$$W = \begin{pmatrix} W_{0,0} & \cdots & W_{0,J} \\ \vdots & \ddots & \vdots \\ W_{I,0} & \cdots & W_{I,J} \end{pmatrix}$$

Next, a process, system or apparatus may determine an ambient lighting conditions using the following equation on W:

$$W^A = \alpha \cdot W^\gamma$$

In this equation, "A" indicates the ambient light condition, $\alpha$ is enhancement factor that may be less than 1.0 in dark environments and larger than 1.0 in bright environments, as just an example. Also, $\gamma$ in the above equation may be used to control the smoothness of the weighting function. For example, in dark environments, $0<\gamma<1.0$, where the smaller the $\gamma$ is, the smoother the resulting function may be. In contrast, in bright environments, $\gamma>1.0$, where the larger the $\gamma$ is, the sharper the curve may be. This process is described in more detail below.

At block 240 in FIG. 2, a process, system or apparatus may filter one or more image characteristic values, such as one or more sub-portion representative values, through one or more light spreading profile weighting functions to generate one or more preliminary luminescent body brightness values. This process is described in more detail below.

In certain embodiments, at block 250 in FIG. 2, a process, system or apparatus may filer one or more brightness values, such as one or more preliminary luminescent body brightness values, through one or more temporal functions to determine one or more luminescent body brightness values. The resultant weighted brightness values may be applied to one or more luminescent bodies to adjust the brightness of at least one luminescent body disposed, at least in part, on a side emitting backlight.

As mentioned above, in this context, a temporal function comprises a function which may be applied to one or more brightness values, such as one or more preliminary luminescent body brightness values, for the current frame and at least one previous signal control value for one or more particular luminescent bodies.

To illustrate an exemplary embodiment of temporal filtering, suppose a particular luminescent body is at location (i,j). For this luminescent body, a process, system or apparatus may determine a preliminary luminescent body brightness value as described above (e.g., preliminary brightness value of luminescent body at (i,j)=max($W^A \cdot R$) where, $W^A$ indicates the light spreading profile weighting function under ambient condition A, R indicates the representative values matrix corresponding to luminescent body(i,j).

Figure 6:
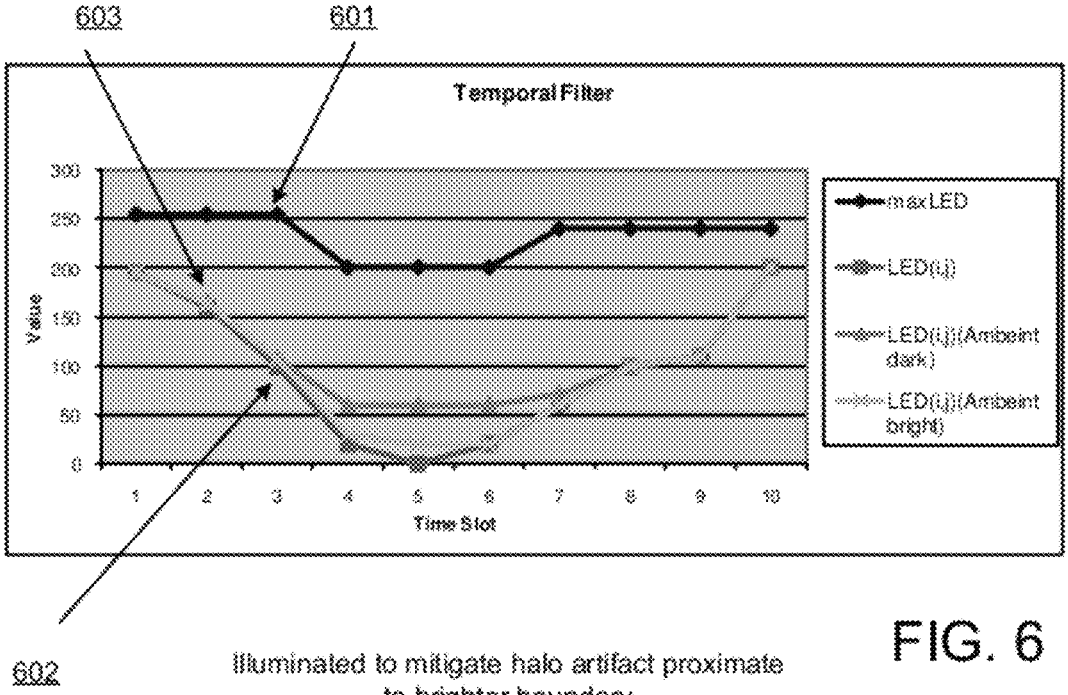
FIG. 6 depicts an exemplary temporal filter in accordance with one or more embodiments.

Next, a process, system or apparatus may determine one or more preliminary luminescent body brightness values for one or more, or each, luminescent body disposed, at least in part, on a side emitting backlight. In this illustration, if at least one preliminary luminescent body brightness values is determined for each luminescent body of the display, a process, system or apparatus may select the maximum preliminary luminescent body brightness value and indicate it as max-$LED^T$ at time slot T. FIG. 6, for example, at 601 depicts a maxLED at time slot 3.

A process, system or apparatus may next apply the following temporal filter:

$$LED(i,j)^T = \max[\text{Ambient Weighting}*\max LED^T, LED(i,j), \alpha*(LED(i,j)^{T-1})]$$

Here, this temporal filter equation demonstrates that a brightness value for LED in location (i,j) at time slot T is selected as the maximum value out of three values. For example, the first value is AmbientWeighting*maxLED$^T$. This value may be used to control for a particular display frame at time T since the minimum LED value should not be less than AmbientWeighting*maxLEDT e.g., (0<AmbientWeighting<1). In a bright ambient condition, as just an example, a smaller AmbientWeighting may be selected, so that the difference between the minimum and maximum LEDs within a frame is relatively larger so that a higher contrast may be obtained. In contrast, in dark ambient conditions, a larger AmbientWeighting may be selected, so that the difference between the minimum and maximum LEDs within a frame is relatively small so that any halo artifact, if one exists, may be minimized.

The second value in the above temporal equation is LED (i,j). This value may be the preliminary luminescent body brightness value calculated as described above. FIG. 6, for example, at 602 depicts a LED(i,j) at time slot 3.

The third value in the above temporal equation is $\alpha$*(LED $(i,j)^{T-1}$). Here, $\alpha$ is a weighting in [0,1], where a larger $\alpha$ indicates a smoother transaction from frame T-1 to T. Thus, $LED(i,j)^{T-1}$ may be a brightness value of LED in location (i,j) in a previous frame T-1. FIG. 6, for example, at 603 depicts a preliminary luminience body brightness $LED(i,j)^{T-1}$ at time slot 2, which is T-1 time slot. In certain embodiments, however, $LED(i,j)^{T-1}$ may not be restricted to preliminary luminance body brightness values at previous frame; for example, other brightness values may be used, such as a luminescent body brightness control value at time slot T-1, or other signal values, which may be able to indicate the brightness properties of LED(i,j) at time slot T-1, as just some examples.

In addition, in certain embodiments, an additional distance weighting may be applied. For example, in certain embodiments, the following temporal filter may be used:

$$LED(i,j)^{T}=\max[\text{Ambient Weighting}*\max LED^{T}*\text{Distance Weighting}, LED(i,j), \alpha*(LED(i,j)^{T-1})]$$

Here, a "Distance Weighting" component is added for value one. In this embodiments, the distance weighting component is inversely proportional to the distance between the LED in location (i,j) and the maxLED (e.g., the preliminary luminescent body brightness value) obtained for each luminescent body.

Figure 7:
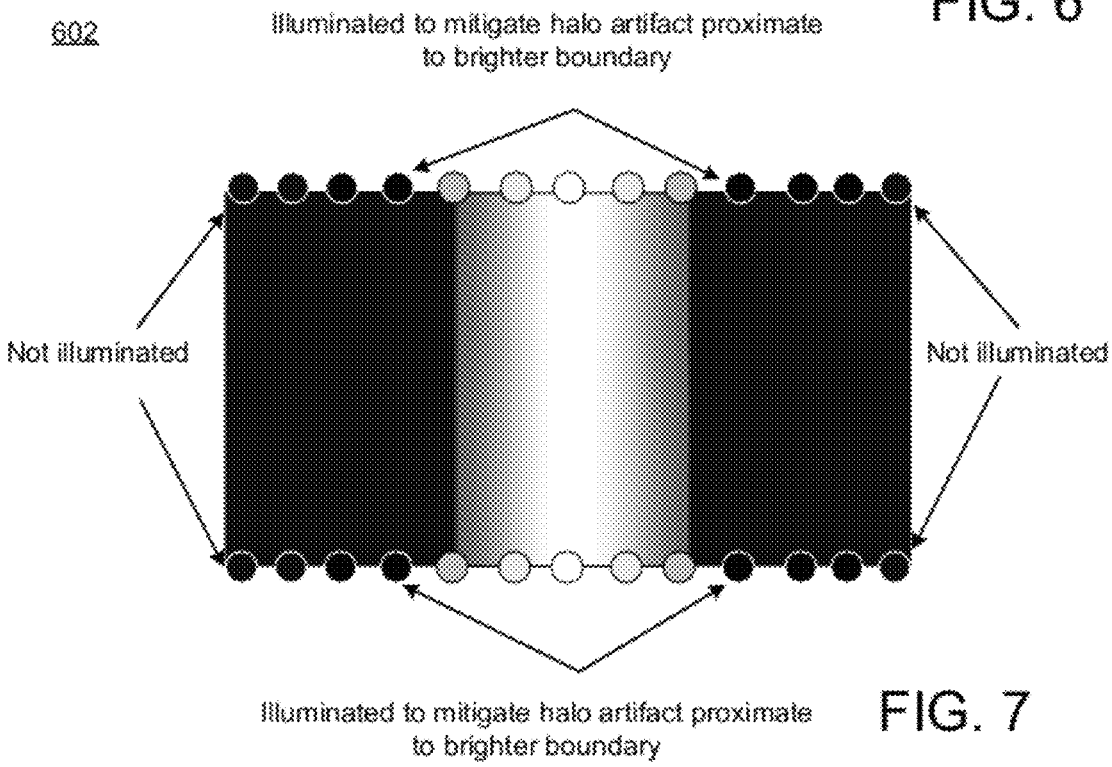
FIG. 7 depicts various luminescent bodies disposed, at least in part, on an edge of an exemplary display screen at various brightness levels, in accordance with one or more embodiments.

FIG. 7 depicts an effect of temporal filtering using a distance weighting component. For example, in FIG. 7, a distance weighting component may illuminate, and/or increase the illumination, of one or more luminescent bodies proximate to more intensely illuminated luminescent bodies. Likewise, a distance weighting component may de-illuminate, and/or decrease the illumination, of one or more luminescent bodies more distant from more intensely illuminated luminescent bodies. Such distance weighting may be useful to mitigate any halo artifacts.

At block 260, a process, system or apparatus may adjust a brightness of one or more luminescent bodies by applying one or more weighted brightness values to one or more luminescent bodies disposed as a part of a side emitting backlight display device.

To illustrate a few of the above processes or operations, suppose control circuit 140 in FIG. 1 may adjust a brightness of the luminescent body depicted in FIG. 8A at location (i,j). Here, for example, control circuit 140 may access one or more image input signal values (which control circuit 140 may process, or which may already be processed, to generate one or more image characteristic values, such as sub-portion representative values) which may correspond to the luminescent body depicted in FIG. 8A. Suppose, for sake of illustration, that sub-portion representative values for the luminescent body in FIG. 8A were determined as described in the above-reference patent (e.g., Representative Value=Max($Peak_{m,n}$) and are represented by the exemplary values depicted in FIG. 8A.

In this illustration, control circuit 140 may determine one or more light spreading profile weighting functions based, at least in part, one or more values representing one or more light spreading profiles and/or one or more ambient light values. Here, exemplary values representing a light spreading profile weighting function are depicted in FIG. 8B.

The representative values in FIG. 8A may be filtered through the light spreading profile weighting function depicted in FIG. 8B to produce the exemplary preliminary luminescent body brightness values depicted in FIG. 8C. Thus, as depicted in FIG. 8C, an exemplary result of max ($W^{A}$·R) equals a preliminary luminescent body brightness value of 157 for an illumination body at (i,j). Also, as mentioned above, such values may be applied to a luminescent body and/or undergo additional filtering, such as temporal filtering, as just an example.

In certain embodiments, in some devices or configurations, a light emitter (e.g., side emitting backlight) and an LCD panel, such as side emitting backlight 120 and LCD panel 130, may be coupled via a control circuit such that a control circuit is operable to adjust a transmissivity of the liquid crystal based, at least in part, in response to light incident on the LCD panel from a light emitter. Thus, as just an example, a control circuit may adjust a transmissivity of an LCD panel in response to one or more backlight adjustments, such as adjustments based at least in part on ambient light values as previously described. Of course, such LCD adjustments may be controlled by one or more components or devices which, for sake of illustration, are not depicted in FIG. 1. For instance, side emitting backlight 120 and/or LCD panel 130 may have various processors, control circuits, or drivers which control one or more interactions between side emitting backlight 120 and LCD panel 130. For convenience, however, and so as to not obscure claimed subject matter, these components or devices are omitted; instead, in embodiment 100, control circuit 140 may perform one more of the functions associated with these various components or devices.

For example, in certain embodiments, at block 270, one or more processes or devices, such as control circuit 140, may adjust an image signal value corresponding to an LCD panel at least in part in response one or more backlight intensity adjustments. To do so, control circuit 140 may process one or more input image signal values using one or more local dimming manipulation techniques. In this context, a local dimming manipulation technique may comprise any technique or approach to selectively modulate a brightness level of LCD transmissivity. Since a variety of local dimming techniques exist, it would not be feasible to list all such techniques. In is noted, then, that while claimed subject matter is not to be limited to any particular technique or approach, one local dimming manipulation technique that may be utilized at block 270, for example, is described in aforementioned U.S. patent application Ser. No. 12/565,635 entitled, "Method, system or apparatus for adjusting a brightness level associated with at least a portion of a backlight of a display device," filed on Sep. 23, 2009. At block 280, one or more processes or operations may apply one or more values processed via one or more local dimming manipulation techniques to adjust a transmissivity of an LCD panel of a display device.

Certain implementations or embodiments may have a variety of advantages. For example, exemplary advantages associated with at least one embodiment may include potentially improved power savings and thermal management characteristics. In certain embodiments, power saving and thermal management may improve, for example, due in part to localized adjustments of backlight intensity based on ambient light incident on or around a particular display device. In addition, exemplary advantages related to display characteristics associated with at least one embodiment may include potentially improved contrast or color performance ratios, as just an example. Furthermore, in at least one embodiment, temporal filtering may mitigate the presence of halo artifacts, as yet another advantage.

In addition, reference is made in the detailed description to the accompanying drawings, which form a part hereof, wherein like numerals may designate like parts throughout to indicate corresponding or analogous elements. It will be appreciated that for simplicity or clarity of illustration, elements illustrated in the figures have not necessarily been drawn to scale. For example, the dimensions of some of the elements may be exaggerated relative to other elements for clarity. Further, it is to be understood that other embodiments may be utilized and structural or logical changes may be made without departing from the scope of claimed subject matter. It should also be noted that directions and references, for example, up, down, top, bottom, and so on, may be used to facilitate the discussion of the drawings and are not intended to restrict the application of claimed subject matter. Therefore, the detailed description is not to be taken in a limiting sense and examples, illustrations, or the like, do not limit the scope of claimed subject matter defined by the appended claims and their equivalents.

The terms, "and," "and/or," and "or" as used herein may include a variety of meanings that will depend at least in part upon the context in which it is used. Typically, "and/or" as well as "or" if used to associate a list, such as A, B or C, is intended to mean A, B, and C, here used in the inclusive sense, as well as A, B or C, here used in the exclusive sense. Reference throughout this specification to "one embodiment" or "an embodiment" or a "certain embodiment" means that a particular feature, structure, or characteristic described in connection with the embodiment is included in at least one embodiment of claimed subject matter. Thus, the appearances of the phrase "in one embodiment" or "an embodiment" or a "certain embodiment" in various places throughout this specification are not necessarily all referring to the same embodiment. Furthermore, the particular features, structures, or characteristics may be combined in one or more embodiments. Embodiments described herein may include machines, devices, engines, or apparatuses that operate using digital signals. Such signals may comprise electronic signals, optical signals, electromagnetic signals, or any form of energy that provides information between locations.

In the preceding description, various aspects of claimed subject matter have been described. For purposes of explanation, specific numbers, systems and/or configurations were set forth to provide a thorough understanding of claimed subject matter. However, it should be apparent to one skilled in the art having the benefit of this disclosure that claimed subject matter may be practiced without the specific details. In other instances, features that would be understood by one of ordinary skill were omitted or simplified so as not to obscure claimed subject matter. While certain features have been illustrated or described herein, many modifications, substitutions, changes or equivalents will now occur to those skilled in the art. It is, therefore, to be understood that the appended claims are intended to cover all such modifications or changes as fall within the true spirit of claimed subject matter.

The invention claimed is:

1. A method, comprising:

accessing a plurality of values representing a light spreading profile for a particular luminescent body, wherein said particular luminescent body is disposed as part of a side emitting backlight of a display device, and wherein said light spreading profile is operable for showing light distribution characteristics of light emitted from said particular luminescent body;

determining a brightness value associated with said particular luminescent body by filtering one or more image characteristic values of an input image through at least one light spreading profile weighting function determined based, at least in part, on said plurality of accessed values representing said light spreading profile, said light spreading profile being used to determine a backlight level for said particular luminescent body;

controlling said brightness value associated with said particular luminescent body based on said determined brightness value associated with said particular luminescent body;

determining a truncated area of an input image according to a predetermined percentage of intensity value of said light spreading profile of said particular luminescent body;

dividing said input image within said truncated area into a plurality of sub-image blocks;

determining a plurality of representative values associated with said plurality of sub-image blocks;

determining said brightness value associated with said particular luminescent body according to said plurality of representative values and said light spreading profile, said determining said brightness value associated with said particular luminescent body comprising;

applying a first matrix of said representative values to a second matrix determined based on said plurality of accessed values representing a light spreading profile of said particular luminescent body; and selecting a maximal value of said determined brightness value as said brightness value.

2. The method of claim 1, wherein determining said brightness value associated with said particular luminescent body according to said plurality of representative values comprises:

filtering said plurality of representative values through said at least one light spreading profile weighting function determined based on said plurality of accessed values of said particular luminescent body.

3. The method of claim 2, further comprising:

filtering one or more of said plurality of representative values through said at least one light spreading profile weighting function through one or more temporal functions.

4. The method of claim 2, wherein determining said brightness value associated with said particular luminescent body further comprises:

determining said at least one light spreading profile weighting function based, at least in part: on said accessed plurality of values representing said light spreading profile for said particular luminescent body; or, on one or more measurements of ambient light values; or, on combinations thereof.

5. The method of claim 1, wherein at least one of said plurality of representative values comprises one or more subportion representative values.

6. The method of claim 1, wherein said second matrix is determined based on said plurality of accessed values representing said light spreading profile and one or more measurements of ambient light values.

7. An apparatus, comprising:

a side emitting backlight comprising a plurality of luminescent bodies, wherein a light spreading profile of at least one particular luminescent body of said plurality of luminescent bodies is operable for showing light distribution characteristics of light emitted from said at least one particular luminescent body;

an LCD panel coupled to said side emitting backlight; and a control circuit electrically coupled to said side emitting backlight and said LCD panel, wherein said control circuit is to:

determine a brightness value associated with said at least one particular luminescent body of said plurality of luminescent bodies by filtering one or more image characteristic values of an input image through at least one light spreading profile weighting function determined based, at least in part, on said plurality of accessed values representing the light spreading profile, said light spreading profile being used to determine a backlight level of said at least one particular luminescent body; and control said brightness value associated with said at least one particular luminescent body of said plurality of luminescent bodies based, at least in part, on one or more values representing said light spreading profile for said at least one particular luminescent body;

determine a truncated area of an input image according to a predetermined percentage of intensity value of said light spreading profile of said at least one particular luminescent body;

divide said input image within said truncated area into a plurality of sub-image blocks:

determine a plurality of representative values associated with said plurality of sub-image blocks;

determine said brightness value associated with said at least one particular luminescent body according to said plurality of representative values and said light spreading profile, wherein, to determine said brightness value, said control circuit is additionally to:

apply a first matrix of said representative values to a second matrix to be determined based on said plurality of accessed values representing a light spreading profile of said at least one particular luminescent body; and select a maximal value of said determined brightness value as said brightness value.

8. The apparatus of claim 7, wherein determining said brightness value associated with said at least one particular luminescent body according to said representative values comprises:

filtering said plurality of representative values through said at least one light spreading profile weighting function determined based on said plurality of accessed values of said at least one particular luminescent body.

9. The apparatus of claim 8, wherein said control circuit is further to apply said plurality of representative values filtered through said light spreading profile weighting function to one or more luminescent bodies disposed as part of a side emitting backlight of a display device.

10. The apparatus of claim 7, wherein said control circuit is further to processing one or more image input signal values using one or more local dimming manipulation techniques.

11. The apparatus of claim 10, wherein said control circuit is further to apply one or more values generated using said one or more local dimming manipulation techniques to at least a portion of said LCD panel to adjust one or more LCD pixel values, at least in part.

12. The apparatus of claim 7, further comprising:

at least one ambient light sensor; wherein said ambient light sensor is further to measure ambient light incident on or around said LCD panel, to determine one or more of said ambient light values.

13. The apparatus of claim 7, wherein said control circuit is further to determine said at least one light spreading profile weighting function based, at least in part: on accessed values of said at least one particular luminescent body; or, on one or more measurements of ambient light values; or, on combinations thereof.

14. The apparatus of claim 7, wherein at least one luminescent body of said plurality of luminescent bodies comprises at least one light emitting diode.

15. The apparatus of claim 7, wherein said side emitting backlight, said LCD panel, and said control circuit comprise at least a portion of a side emitting backlight display device further to display an image.

16. The apparatus of claim 15, wherein said side emitting backlight display device is further to display an image comprises at least one of the following: a television, a handheld device, a computer device, or combinations thereof.

17. An apparatus, comprising:

means for accessing one or more values representing alight spreading profile for a particular luminescent body, wherein said light spreading profile is operable for showing light distribution characteristics of light emitted from said particular luminescent body;

determining a brightness value associated with said particular luminescent body by filtering one or more image characteristic values of an input image through at least one light spreading profile weighting function determined based, at least in part, on said plurality of accessed values representing the light spreading profile, said light spreading profile being used to determine a backlight level for said particular luminescent body;

means for controlling said brightness value of associated with said particular luminescent body based on said determined brightness values associated with said particular luminescent body;

means for determining a truncated area of an input image according to a predetermined percentage of intensity value of said ht spreading profile of said particular luminescent body;

means for dividing said input image within said truncated area into a plurality of sub-image blocks;

means for determining a plurality of representative values associated with said plurality f sub-image blocks; and means for determining said brightness value associated with said particular luminescent body according to said plurality of representative values and said light spreading profile, said means for determining said brightness value associated with said particular luminescent body comprises;

means for a lna first matrix of said representative values to a second matrix determined based on said plurality of accessed values representing a light spreading profile of said particular luminescent body; and means for selecting a maximal value of said determined brightness value as said brightness value.

18. The method of claim 1, wherein said at least one light spreading profile weighting function is determined based, at least in part, on said plurality of accessed values representing the light spreading profile of said particular luminescent body and one or more ambient light values, and said at least one light spreading profile weighting function is smoother with respect to a decrement of the brightness of said one or more ambient light values, and is sharper with respect to an increment of the brightness of said one or more ambient light values.

* * * * *